US006550551B2

(12) United States Patent
Brunnert et al.

(10) Patent No.: US 6,550,551 B2
(45) **Date of Patent: *Apr. 22, 2003**

(54) APPARATUS TO ACTUATE A DOWNHOLE TOOL

(75) Inventors: David J. Brunnert, Houston, TX (US); Thurman H. Carter, Houston, TX (US); David M. Haugen, League City, TX (US); Gary D. Ingram, Richmond, TX (US); David W. Teale, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/041,901

(22) Filed: Jan. 8, 2002

(65) Prior Publication Data

US 2002/0060096 A1 May 23, 2002

Related U.S. Application Data

(63) Continuation of application No. 09/547,068, filed on Apr. 11, 2000, now Pat. No. 6,364,037.

(51) Int. Cl.[7] ..... E21B 34/10
(52) U.S. Cl. ..... 175/61; 175/274; 166/324
(58) Field of Search ..... 166/324, 386; 175/61, 62, 73, 230, 263, 267, 269, 274, 45.1, 45.2

(56) References Cited

U.S. PATENT DOCUMENTS

| | | | | |
|---|---|---|---|---|
| 2,359,067 A | 9/1944 | Warren | ..... | 255/1.6 |
| 3,595,326 A | 7/1971 | Claycomb | ..... | 175/73 |
| 4,554,981 A | 11/1985 | Davies | ..... | 175/4.52 |
| 4,566,540 A | 1/1986 | Pringle et al. | ..... | 166/317 |
| 4,648,470 A | 3/1987 | Gambertoglio | ..... | 175/4.54 |
| 4,781,536 A | 11/1988 | Hicks | ..... | 417/12 |
| 5,101,904 A | 4/1992 | Gilbert | ..... | 166/319 |
| 5,170,844 A | 12/1992 | George et al. | ..... | 166/319 |
| 5,180,015 A | 1/1993 | Ringgenberg et al. | ..... | 166/386 |
| 5,411,097 A | 5/1995 | Manke et al. | ..... | 166/324 |
| 5,443,129 A | 8/1995 | Bailey et al. | ..... | 175/45 |
| 5,771,972 A | 6/1998 | Dewey et al. | ..... | 166/298 |
| 5,775,428 A | 7/1998 | Davis et al. | ..... | 166/381 |
| 6,116,336 A | 9/2000 | Adkins et al. | ..... | 166/55.7 |

FOREIGN PATENT DOCUMENTS

| | | | |
|---|---|---|---|
| EP | 0 539 020 | 4/1993 | ..... E21B/34/10 |
| EP | 0 994 238 | 4/2000 | ..... E21B/49/00 |
| GB | 2 303 158 | 2/1997 | ..... E21B/7/08 |
| WO | WO 99/47789 | 3/1999 | ..... E21B/34/10 |
| WO | WO 99/64715 | 12/1999 | ..... E21B/29/06 |

OTHER PUBLICATIONS

Greg Miller, et al. "Sidetracking in a Single Trip," Smith International, Inc., SPE/IADC Drilling Conference, Amsterdam, The Netherlands, Mar. 4–6, 1997 pp. 785–791, XP–002179731.

PCT International Search Report from PCT/GB 01/01567, Dated Oct. 31, 2001.

PCT Partial International Search Report from PCT/GB 01/01567, Dated Aug. 22, 2001.

*Primary Examiner*—Frank S. Tsay
(74) *Attorney, Agent, or Firm*—Moser, Patterson & Sheridan, L.L.P.

(57) ABSTRACT

The invention provides an apparatus for actuating a downhole tool by utilizing a pressure differential created by fluid flowing through a conduit. The conduit is in communication with a pressure sensing line that is selectively exposable to areas of the conduit having different pressures. By exposing the pressure sensing line to a portion of the conduit having a predetermined pressure therein, the pressure sensing line cause actuation of a hydraulic tool therebelow.

42 Claims, 5 Drawing Sheets

APPARATUS TO ACTUATE A DOWNHOLE TOOL

CROSS-REFERENCE TO RELATED APPLICATIONS

This application is a continuation of U.S. patent application Ser. No. 09/547,068, filed Apr. 11, 2000 now U.S. Pat. No. 6,364,037. The aforementioned related patent application is herein incorporated by reference.

BACKGROUND OF THE INVENTION

1. Field of the Invention

This invention relates generally to methods and apparatus for actuating a tool in a borehole. More particularly, the invention relates to orienting or positioning a tool in a borehole and, once properly oriented, setting the tool in a fixed position. Still more particularly, the invention relates to an actuation apparatus that uses a pressure differential in a conduit carrying a fluid flow to actuate a downhole hydraulic tool.

2. Description of the Related Art

Hydraulically-actuated tools such as packers and anchor assemblies have long been used in the drilling industry. A tool often used in conjunction with anchors or packers is a whipstock. A whipstock includes an inclined face and is typically used to direct a drill bit or cutter in a direction that deviates from the existing borehole. The combination whipstock and anchor (or packer) is frequently termed a sidetrack system. Sidetrack systems have traditionally been used to mill a window in the well casing, and thereafter to drill through the casing window and form the lateral borehole.

Originally, such a sidetrack operation required two trips of the drill string. The first trip was used to run and set the anchor or packing device at the appropriate elevation in the borehole. With the anchor or packer in place, the drill string was then removed from the well and a survey was made to determine the orientation of a key on the upper end of the anchor-packer. With that orientation known, the whipstock was then configured on the surface so that when the whipstock engaged the anchor-packer in the borehole, it would be properly oriented. So configured, the whipstock, along with an attached cutter, was then lowered in the borehole on the drill string and secured to the anchor-packer. Once connected to and supported by the packer, the whipstock directed the cutter so that a window would be milled in the casing of the borehole at the desired elevation and in the preselected orientation. This two-trip operation for setting the anchor-packer and then lowering the whipstock and cutter is time-consuming and expensive, particularly in very deep wells.

To eliminate the expense associated with two trips of the drill string, an improved sidetrack system was developed which required only a single trip. Such a system includes a whipstock having an anchor-packer connected at its lower end, and a cutter assembly at its upper end connected by a shearable connection. Using such a system, the whipstock is oriented by first lowering the apparatus into the cased borehole on a drill string. A wireline survey instrument is then run through the drill string to check for the proper orientation of the suspended whipstock. After the whipstock is properly oriented in the borehole, and the anchor-packer set, the drill string is then lowered causing the cutter assembly to become disconnected from the whipstock. As the cutter is lowered further, the inclined surface of the whipstock cams the rotating cutter against the well casing, causing the cutter to mill a window in the casing at the predetermined orientation and elevation.

To be contrasted with wireline devices, there exist today a variety of systems that are capable of collecting and transmitting data from a position near the drill bit while drilling is in progress. Such measuring-while-drilling ("MWD") systems are typically housed in a drill collar at the lower end of the drill string. In addition to being used to detect formation data, such as resistivity, porosity, and gamma radiation, all of which are useful to the driller in determining the type of formation that surrounds the borehole, MWD tools are also useful in surveying applications, such as, for example, in determining the direction and inclination of the drill bit. Present MWD systems typically employ sensors or transducers which, while drilling is in progress, continuously or intermittently gather the desired drilling parameters and formation data and transmit the information to surface detectors by some form of telemetry, most typically a mud pulse system. The mud pulse system creates acoustic signals in the drilling mud that is circulated through the drill string during drilling operations. The information acquired by the MWD sensors is transmitted by suitably timing the formation of pressure pulses in the mud stream. The pressure pulses are received at the surface by pressure transducers which convert the acoustic signals to electrical pulses which are then decoded by a computer.

MWD tools presently exist that can detect the orientation of the drill string without the difficulties and drawbacks described above that are inherent with the use of wireline sensors. However, known MWD tools typically require drilling fluid flow rates of approximately 250 gallons per minute to start the tool, and 350 to 400 gallons per minute to gather the necessary data and transmit it to the surface via the mud pulse telemetry system. The conventional bypass valves used in present-day sidetrack systems for circulating drilling fluid and transporting a wireline sensor to the whipstock tend to close, and thereby actuate the anchor-packer, at flow rates of approximately 100 gallons per minute, or even less. Thus, while it might be desirable to combine MWD sensors in a sidetrack system, if drilling mud was circulated through the drill string at the rate necessary for the MWD tool to detect and communicate to the driller the orientation of the whipstock, the bypass valve would close and the anchor-packer would be set prematurely, before the whipstock was properly oriented.

An improved apparatus for setting a hydraulically actuatable downhole tool in a borehole is disclosed in U.S. Pat. No. 5,443,129, assigned on its face to Smith International, Inc. and that patent is incorporated herein by reference in its entirety. The '129 apparatus utilizes a bypass valve located in the run-in string below the MWD device and above the cutter. The valve is in an open position while the MWD device is operating thereby diverting fluid flow and pressure from the tubular to the annulus without creating a pressure sufficient to actuate a downhole tool. Upon completion of operation of the MWD device, the bypass valve is remotely closed. Thereafter, selectively operable ports in the cutter are opened and the tubular therebelow is pressurized to a point necessary to actuate the tool. While the,apparatus of the '129 patent allows operation of a MWD device without the inadvertent actuation of a downhole tool, the bypass valve is complex requiring many moving parts and prevents the continuous flow of fluid through the cutter. Additionally, fluid borne sediment tends to settle and collect in the cutter.

There is a need therefore, for a single trip sidetrack apparatus permitting a continuous flow of well fluid therethrough while allowing the actuation of a hydraulically actuated tool at a predetermined position in the borehole. There is a further need therefore, for a single trip sidetrack apparatus that includes a MWD device that can be continuously operated. There is a further need for a single trip sidetrack apparatus that does not depend on a value to prevent inadvertent actuation of a downhole tool. There is yet a further need for an actuation apparatus that allows fluid to flow therethrough before and during actuation of a downhole tool.

SUMMARY OF THE INVENTION

The invention provides an apparatus for actuating a downhole tool by utilizing a pressure differential created by fluid flowing through a conduit. The conduit is in communication with a pressure sensing line that is selectively exposable to areas of the conduit having different pressures. By exposing the pressure sensing line to a portion of the conduit having a predetermined pressure therein, the pressure sensing line causes actuation of a hydraulic tool therebelow.

In one aspect of the invention, fluid flowing through the conduit is utilized to operate a MWD. Thereafter, the pressure line is exposed to a predetermined pressure and the hydraulic tool is actuated. In another aspect of the invention, the pressure in a given area of the conduit is increased due to a restriction therein. At a predetermined time, the pressure line is exposed to the given area and pressure therein actuates the hydraulic tool. The invention includes a running assembly on a drill string, the assembly including an MWD, a pressure changing and sensing mechanism and a cutter.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

The invention comprises a sidetrack system 100 useful for offsetting a borehole by directing a drill bit or cutter at an angle from the existing borehole. As will be understood by those skilled in the art, however, the principles of the invention can be applied to orient and fix other downhole, hydraulically-actuated tools in a single trip of the drill string. Thus, it being understood that the sidetrack system 100 is merely the preferred embodiment of practicing Applicants' invention, and that the invention is not limited to a sidetrack system, the preferred embodiment will now be described in greater detail.

Figure 1:
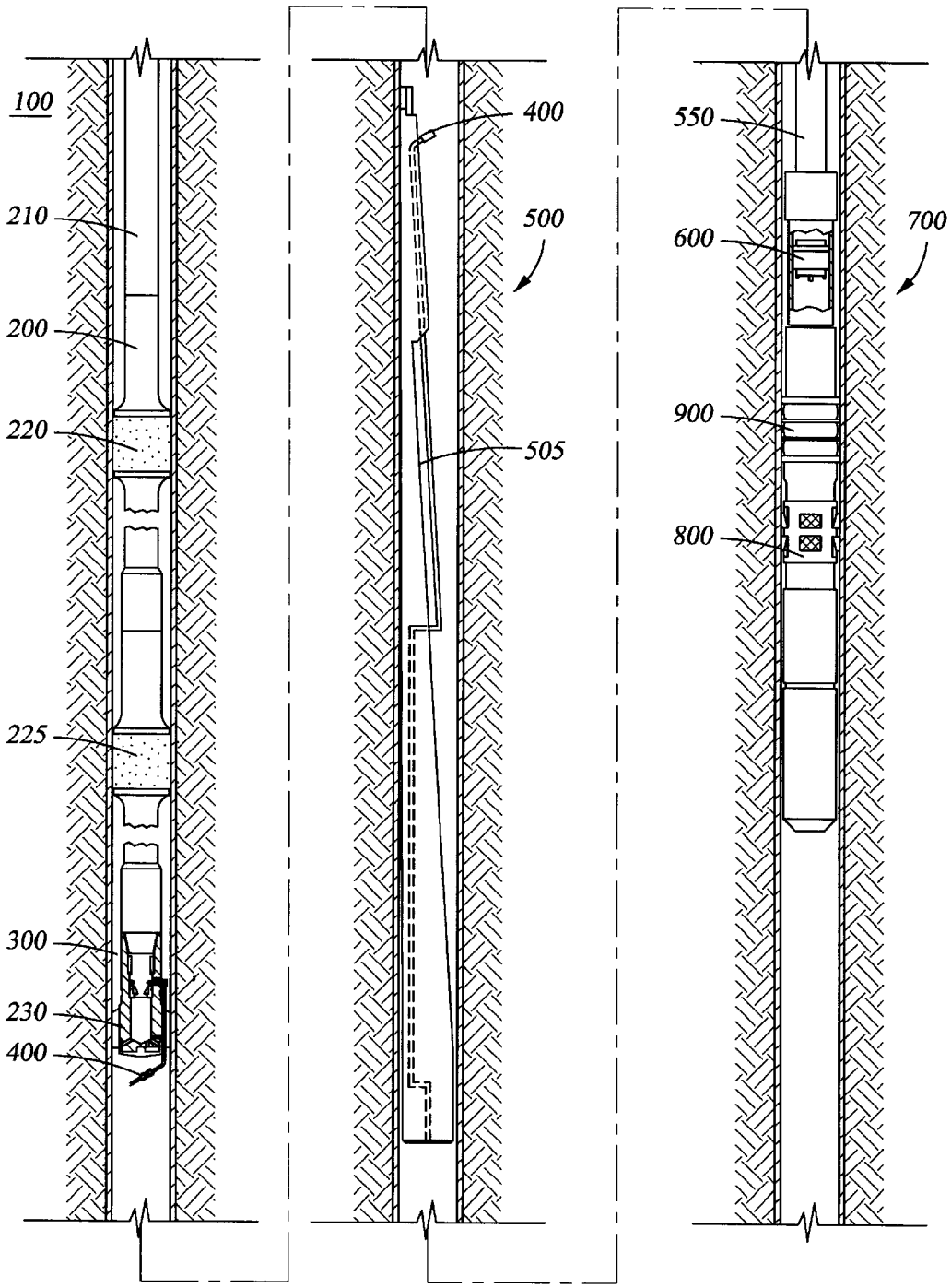
FIG. 1 is an elevation view, partly in cross-section, of a borehole with the sidetrack system of the present invention suspended therein.

FIG. 1 is an elevation view, partially in section of the sidetrack system 100 of the present invention. The sidetrack system 100 is shown attached at the lower end of a tubular string 200 that is run into a borehole 105 that is lined with casing. The invention is not limited to use in a cased borehole, but is equally applicable to open, noncased boreholes. Thus, throughout this disclosure, the term "borehole" shall refer both to cased holes and open holes.

Sidetrack system 100 generally includes a MWD device 210, an upper actuation apparatus 300, a window mill 230, a whipstock 500, a lower actuation supporter 600, and a hydraulically operated downhole tool 700. Secondary mill 225 and stabilizer mill 220 aid in formation of the new borehole. At a lower end, whipstock 500 is disposed over an extension member 550 which is fixed to the lower actuation apparatus 700. Extension member 550 is slightly bent at an angle of about 1/20 in order to ensure the non-concave side of the whipstock remains flush against the borehole wall 105. At the upper end of apparatus 100 is MWD subassembly 210. To provide the driller with intelligible information at the surface of borehole 105 that is representative of the orientation of the sidetrack system 100, and to provide a variety of other downhole measurements and data, the MWD sub 210 includes a conventional mud pulse telemetry system. The mud pulse telemetry system is well understood by those skilled in the art, thus only a brief description of the system is provided herein. Mud pumps located at the surface of the well circulate drilling mud into the top of the drill string. The mud is conducted through the drill string into MWD sub 210 where it passes through a mud pulser that repeatedly interrupts the mud flow to produce a stream of pressure pulses in the circulating drilling mud that can be detected at the surface by pressure transducers.

After the mud passes through pulser valve in MWD sub 210, it flows through a turbine which provides electrical power for the MWD components. Alternatively, batteries may be used to provide the needed power. Housed in MWD sub 210 are a number of sensors which include a three axis accelerometer which measures the earth's gravitational vector relative to the tool axis and a point along the circumference of the tool called a scribe line (not shown), from which the driller can determine the inclination of MWD sub 24 and "tool face."

The rate of rotation of pulser valve is modulated by an electronic controller in response to a train of signals received from an electronic package. The measurements and data from the various MWD sensors, which are electrically interconnected with electronics package, form discrete portions of the control train of signals sent to controller by electronics package. Thus, the pressure pulses that are received at the surface by transducers are representative of the directional measurements and other data detected downhole by MWD sensors. These signals are then analyzed by computer on a continuous basis to determine the inclination, azimuth and other pertinent information which is displayed to an operator by means of monitor and recorded by recorder. As described hereafter, operation of the MWD can be performed without actuating the downhole tool because a greater amount of pressure is required to actuate the tool that is required to operate the MWD. After operation of the new device, the downhole tool can be actuated prior to separation of the cutter, from the whipstock 500. Whipstock 500 comprises an elongate generally tubular member having an inclined face 505 which, once properly oriented in the borehole, is used to cam window mill 230 into engagement with the casing 105. The interior of whipstock 500 includes a pressure sensing line 400 for transmitting pressure from an upper actuation apparatus 300 to a lower actuation apparatus 600 as will be described fully herein.

In the embodiment illustrated, the downhole tool 700 includes a packer 900 and a anchor 800. Packer 900 is a hydraulically actuated subassembly which, upon actuation, attaches to the borehole casing at a predetermined elevation so as to seal the portion of the borehole below the packer from the portion above it. Anchor 800 is a hydraulically-actuatable mechanism which, upon delivery of a pressurized fluid at a predetermined pressure through internal conduit system becomes set in the casing 105 so as to support whipstock 500. Anchor 800 includes a set of slips and cones that fix the sidetrack system in the borehole.

Figure 2A:
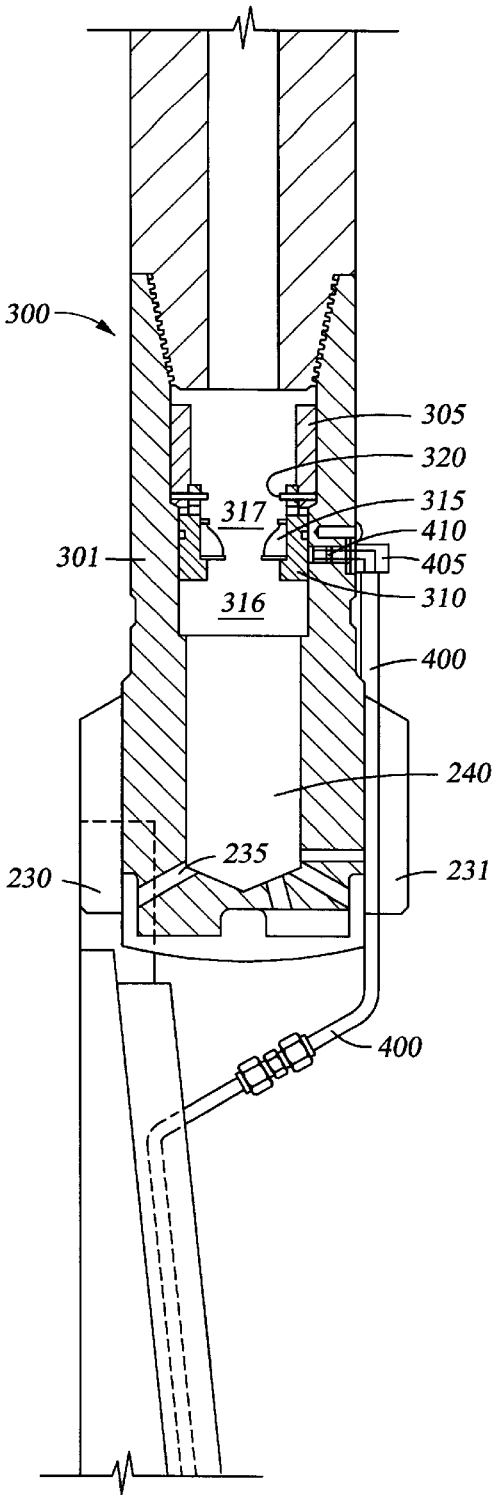
FIG. 2A is a section view showing an upper actuation apparatus in an un-actuated state.
Figure 2B:
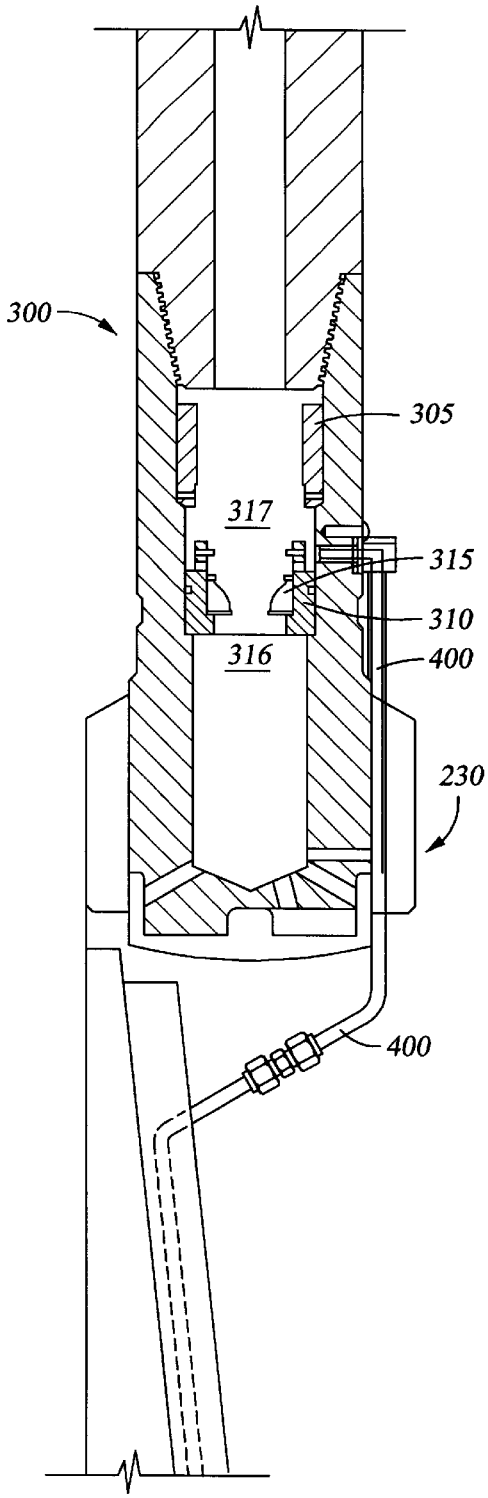
FIG. 2B is a section view showing the upper actuation apparatus in an actuated state.

In the preferred embodiment, the downhole tool 700 is actuated by sequential actions of upper 300 and lower 400 actuation apparatus. The components making up upper actuation apparatus 300 are visible in FIGS. 2A and 2B. Upper actuation apparatus 300 is installed in a tubular member 301 above window mill 230. The window mill 230 includes a plurality of cutters 231 and flow ports 235 which provide an exit for fluids pumped through tubular member 301 from the well surface. FIG. 2A is a section view of upper actuation apparatus 300 in an unactuated state and FIG. 2B is a section view of upper actuation apparatus 300 in its actuated state. The apparatus 300 includes a moveable sleeve 310. In the unactuated position illustrated in FIG. 2A, the moveable sleeve 310 is attached to an upper stationary portion 305 with a shearable connection 320 comprising at least one shearable member which is constructed and arranged to fail upon application of a certain force thereto. The force exerted upon the shearable connection is determined by the flow rate and pressure of fluid through apparatus 300. While a shearable connection with shear members or pins is used in the preferred embodiment, the invention can be used with any releasable connection means.

Moveable sleeve 310 includes restriction 315 in the inner diameter thereof which serves to restrict the flow of fluid through tubular member 301. As fluid passes through upper actuation apparatus 300 and encounters restriction 315, the pressure of the fluid drops in a region 316 directly below restriction 315 and increases in a region 317 directly above restriction 315 thereby creating a pressure differential between the two regions 316, 317. Conversely, the velocity of the fluid decreases in area 317 and increases in area 316. Formed in a wall of tubular member 301 is a pressure port 410. Connected in fluid communication to pressure port 410 through a fitting 405 is a pressure sensing line 400. As depicted in FIG. 2A, when the upper actuation apparatus is in its unactuated state, the pressure sensing line is in communication with lower pressure region 316 on the downhole side of restriction 315.

In order to actuate the upper actuation apparatus 300, fluid at a predetermined flow rate is applied through tubular member 301. As the fluid moves through restriction 315, pressure rises in region 317. A certain flow rate will produce a force at restriction 315 corresponding to the pressure differential and adequate to overcome the shear strength of the shearable members making up the shearable connection 320. Thereafter, the lower moveable sleeve 310 will move into the position illustrated in FIG. 2B.

As shown in FIG. 2B, in its actuated position, the upper actuation apparatus 300 places pressure sensing line 400 in fluid communication with region 317 of tubular member 301 above the restriction 315. In this manner, the pressure sensing line 400 is exposed to the higher pressure created by the flow of fluid through restriction 315. The pressure sensing line 400 transmits this increased pressure to lower actuation apparatus 600 described hereafter.

Using upper actuation apparatus 300, the sidetrack system of the present invention can pass a flow rate of fluid therethrough sufficient to operate a MWD device located in a running string without actuating a hydraulically operated tool therebelow. After operation of the MWD, the flow rate of fluid can be increased to that level which creates a force sufficient to overcome the shear resistance of shearable connection 320 of the upper actuation apparatus 300 and the downhole tool may then be actuated directly or indirectly.

Figure 3A:
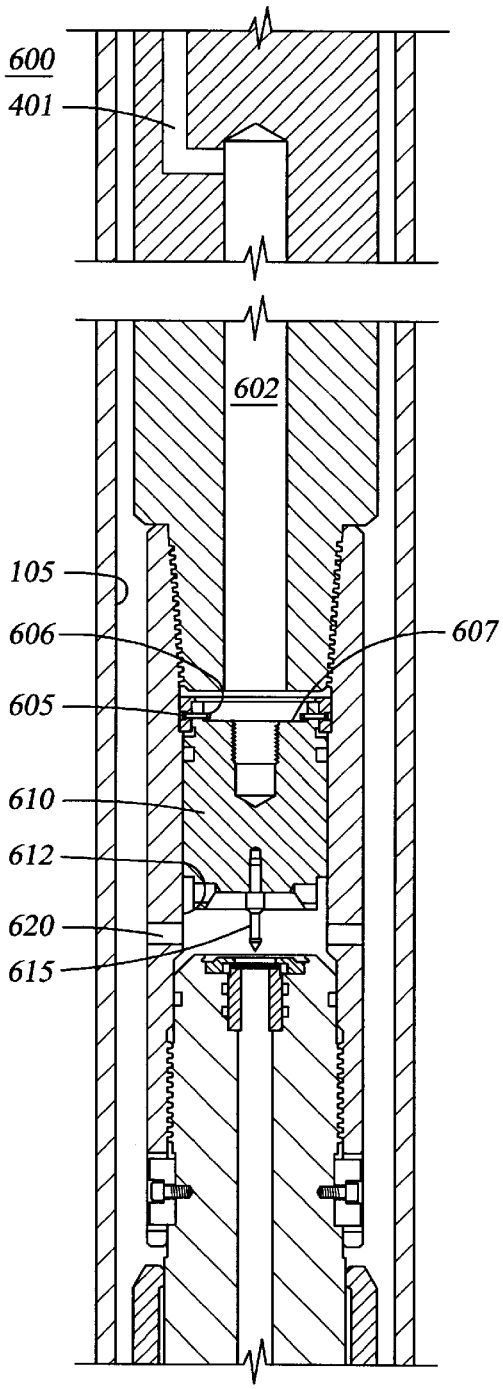
FIG. 3A is a section view showing a lower actuation apparatus in an unactuated state.
Figure 3B:
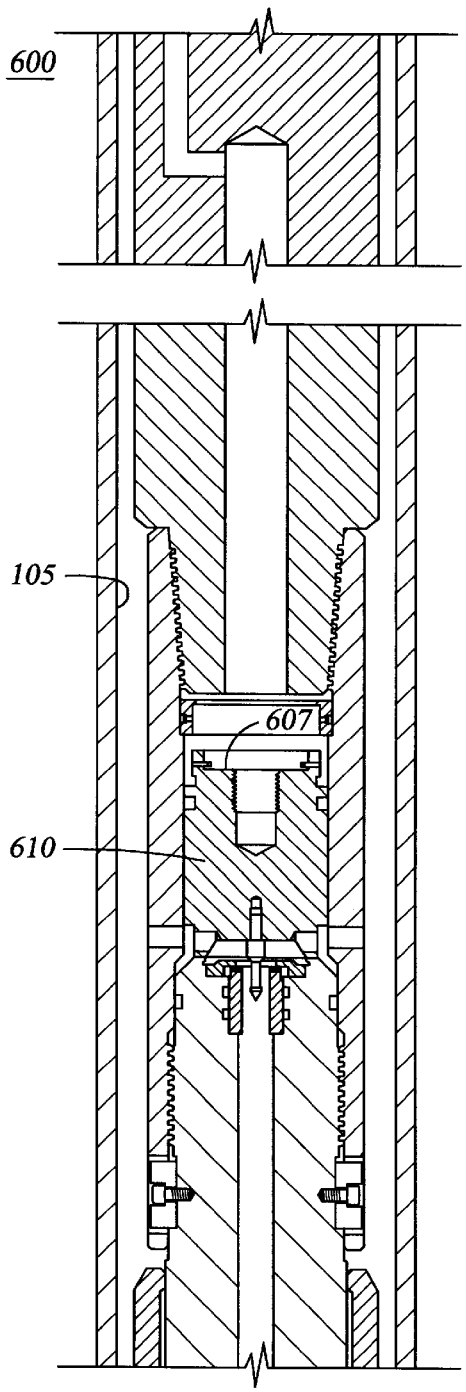
FIG. 3B is a section view showing the lower actuation apparatus in an actuated state.

Lower actuation assembly 600 is installed directly above downhole tool 700 and is depicted in FIGS. 3A and 3B. FIG. 3A is a section view showing lower actuation assembly 600 in an unactuated position and FIG. 3B shows the assembly 600 in an actuated position. The actuation assembly 600 is installed in the inner bore 612 of a tubular member 601. The assembly comprises a piston 610 which is fixed to inner bore 612 with a shearable connection 605 including at least one shear pin 606. Located above piston 610 is area 602 in fluid communication with a pressure bore 401. Pressure bore 401 communicates with pressure sensing line 400 thereabove and places a face 607 of piston 610 in fluid communication with pressurized fluid in pressure sensing line 400. Communication between the pressure sensing line 400 and face 607 of piston 610 exposes the piston face to that pressure present in pressure sensing line 400. Shearable connection 605 is designed to withstand a force created by the pressure present in the pressure sensing line 400 while the upper actuation apparatus is in its unactuated position and the pressure sensing line 400 is in communication with lower pressure are 316 on the downhole side of restriction 315 (FIG. 2A).

When shearable connection 320 of upper actuation apparatus 300 fails and lower movable sleeve 310 moves to the position illustrated in FIG. 2B, the change in pressure creates a force causing shearable connection 605 of lower actuation assembly 600 to fail and piston 610 moves into the position depicted in FIG. 3B. Piston 610, on its lower face 608, includes a puncture pin 615 extending downward therefrom which is designed to puncture an atmospheric chamber formed in downhole tool 700 as described hereafter. Also formed in tubular member 601 is at least one access port 620, arranged to place the inner bore 612 of tubular member 601 into fluid communication with borehole fluid present in the annular space between tubular member 601 and borehole 105.

Figure 4A:
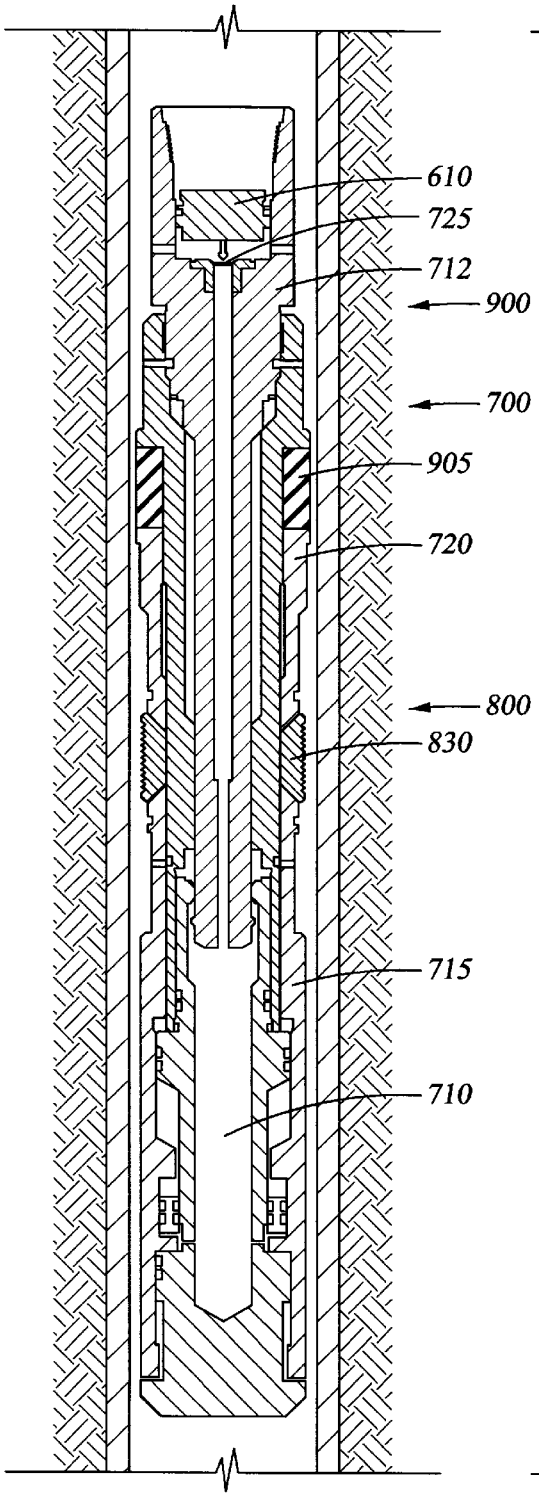
FIG. 4A is a section view showing a hydraulically operated downhole tool in an unactuated state.
Figure 4B:
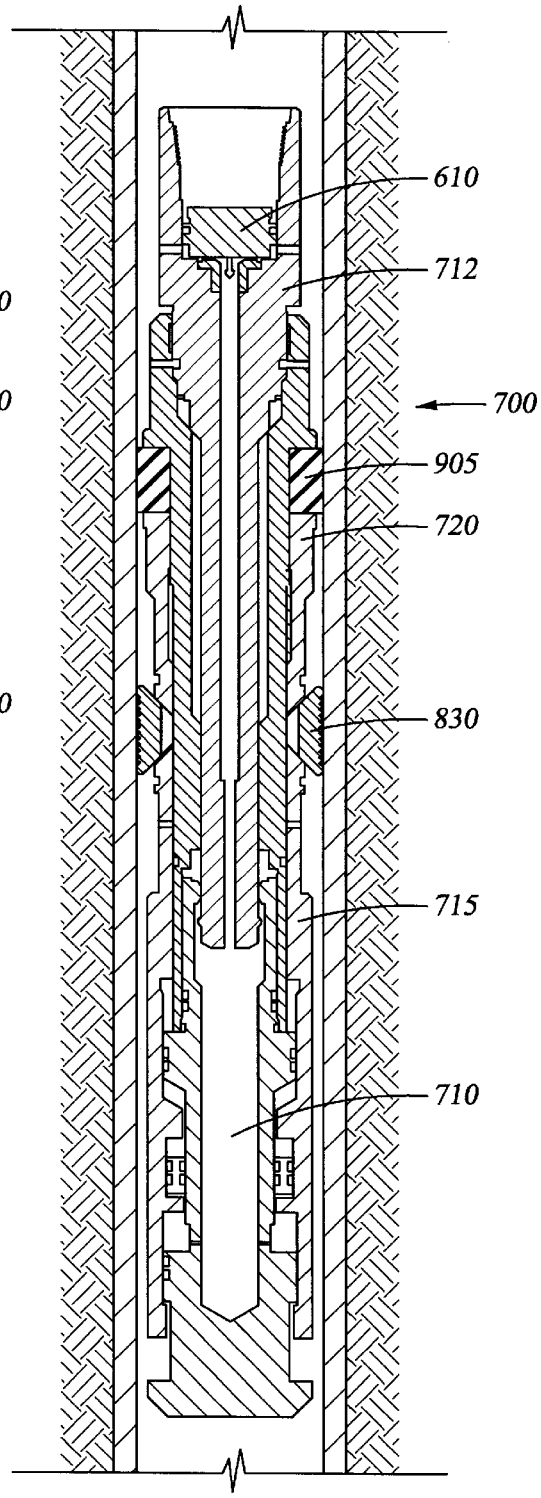
FIG. 4B is a section view showing a hydraulically operated downhole tool in an actuated state.

In the present embodiment, lower actuation assembly 600 is constructed and arranged to actuate a hydraulically actuatable downhole tool 700 which utilizes at least one atmospheric chamber therein. Such a downhole tool is illustrated in FIGS. 4A and 4B. FIG. 4A is a section view of a downhole tool in an unactuated position and FIG. 4B is a section view of the tool in an actuated position. In the example shown in FIGS. 4A and 4B, hydraulically actuated downhole tool 700 includes an anchor assembly 800 designed to fix the tool 700 in a borehole and a packer 900 designed to seal an annular area between the tool 700 and the borehole. As shown in FIG. 4A, the tool is located in a tubular 701 and includes an inner 712 and an outer piston 715 axially movable within the tubular 701 and an upper piston portion 720, also movable within the tubular 701. Disposed between the upper piston portion 720 and the outer piston 715 is a set of slips 830 which, when forced against the wall of the borehole, anchors the tool in the borehole.

A packer 900 with expandable members 905 is located above the anchor and is also actuated by force upon the expandable members from the outer piston 715 and upper piston portion 720. An atmospheric chamber 710 formed inside the tool communicates with borehole fluid at a different pressure when the tool is actuated by failure of a rupture disk 725. While the chamber 710 is referred to as an atmospheric chamber it will be understood that the contents of the chamber need not be at atmospheric pressure but only at some pressure different than the borehole pressure therearound.

Piston areas formed on the inner 712 and outer 715 pistons cause the outer piston 715 to move in relation to the inner piston 712. Slips 830 are urged outwards by sloped surfaces at the bottom of upper piston portion 720 and the top of outer piston 715 to assume that position against the borehole as shown in FIG. 4B. Likewise, relative axial movement between the upper piston portion 720 and inner piston 712 compresses the packer elements 905 and seals the annulus between the tool and the borehole. In the embodiment shown, the chamber 710 includes a rupture disk 706 formed at top thereof and designed to expose the atmospheric chamber to the borehole pressure in communication with the interior of the tool through at least one access port 620 (FIG. 3A). FIG. 4B illustrates the hydraulic tool 700 in its actuated state. Rupture disk 706 of atmospheric chamber 710 has been punctured by puncture pin 615 formed at the bottom of piston 610. In this manner, the interior of atmospheric chamber 710 has been exposed to borehole pressure through a channel formed in part by access port 620. The pressure differential between the atmospheric chamber 710 and the borehole pressure has caused pistons 715, 712 to move relative to one another. Slips 830 have been forced outwards, setting the anchor assembly and fixing the tool in the borehole. Additionally, the movement of the outer piston 715 and upper piston portion 720 has squeezed expandable members 905 of packer 900 causing them to expand and seal the annulus created between the body 705 and the inner wall of casing 105. With the sidetrack system set in place in the borehole and the annulus therearound sealed, the window mill 230 may be separated from whipstock 500 and the formation of the lateral borehole can begin.

The sidetrack system 100 of the present invention, when used with a MWD is operated in the following steps: The apparatus is lowered into the borehole with the MWD, a stabilizer mill 220, a second mill 225, the upper actuation apparatus 300 and the window mill 230 arranged in series in the string of drill pipe. A shearable connection 250 connects the window mill to whipstock 500 and at the lower end of whipstock 500 an extension 550 connects the whipstock 500 to lower actuation apparatus 600 and also ensures that whipstock 500 is positioned properly against the wall of borehole 105. Below lower actuation apparatus 600 is hydraulically actuated downhole tool 700 including packer 900 and hanger 800.

After the apparatus 100 is at a predetermined depth in the borehole, the MWD device is operated by well fluid flowing therethrough. As the MWD device operates, well fluid travels down tubular string 200, through upper actuation apparatus 300, into window mill 230 and exists through flow ports 235. Throughout the operation of the MWD, the shearable connection 320 of the upper actuation apparatus 300 withstands pressure generated by fluid flowing therethrough and pressure sensing line 400 continues to sense pressure on the uphole side of restriction of 315.

After the MWD device operation has been completed, the flow rate of fluid from the surface of the well is increased and pressure generated by the flowing fluid upon restriction 315 causes the shearable connection 320 to fail and the lower moveable sleeve 310 to break free and move downward in the tubular member 301 to a second position. At this point, pressure sensing line 400 is exposed to the uphole pressure generated by fluid flow against restriction 315. The pressure and pressure sensing line 400 is a predetermined pressure adequate to cause shearable connection 605 holding piston 610 in place in lower actuation assembly 600. As shear pin 606 fails and piston moves to a second position within tubular member 601, the frangible member sealing the atmospheric chamber of the downhole tool is ruptured and the atmospheric chamber is exposed to fluid at borehole pressure via access ports 620. The pressure differential between the atmospheric chamber and borehole fluid causes the annular piston in the hydraulically operated downhole tool 700 to move towards the surface of the well, thereby actuating packer 900 which seals the annular area between the tool and the casing wall and hanger 800 which fixes the downhole tool vertically in the casing wall.

Figure 5:
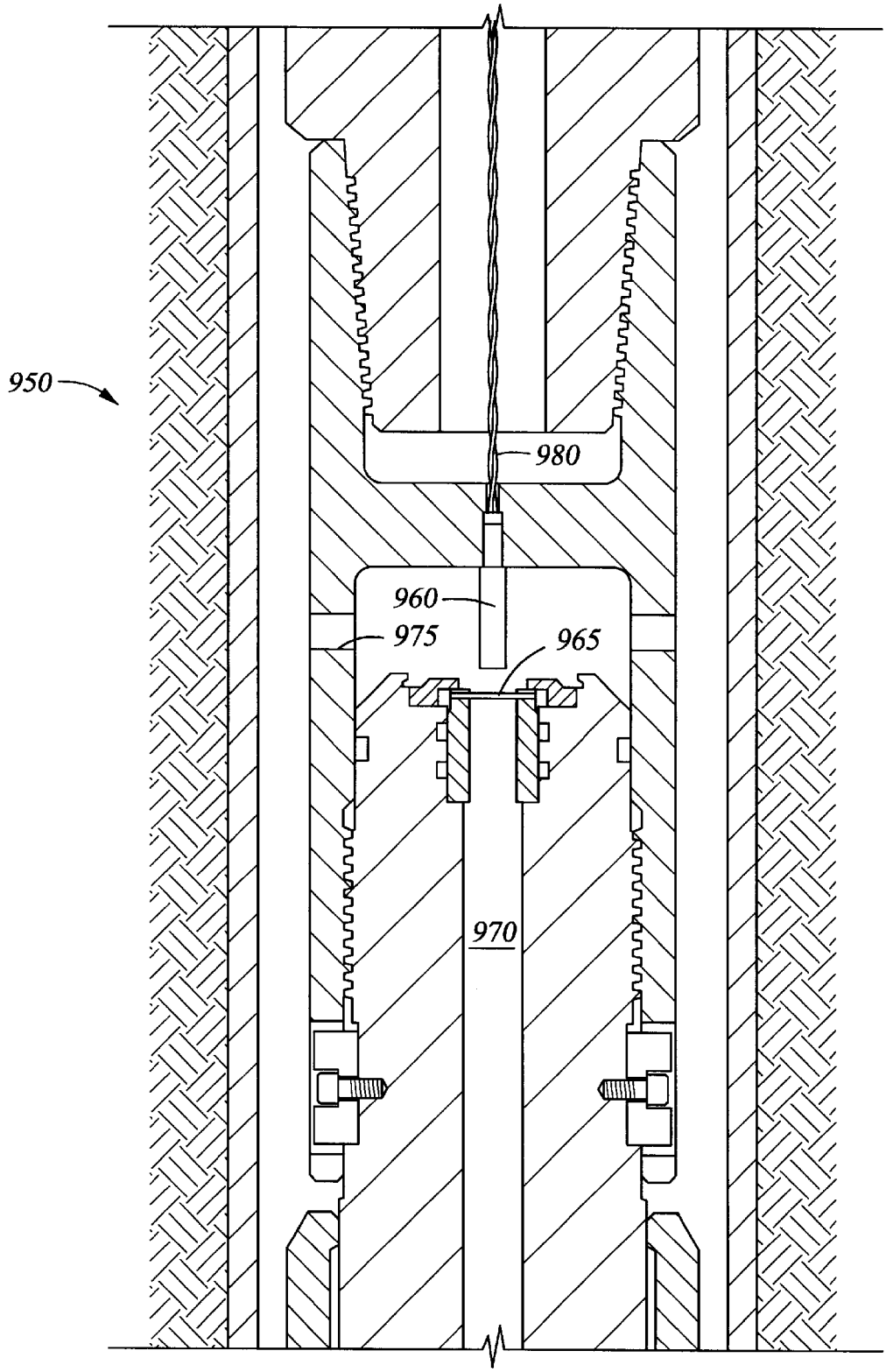
FIG. 5 is a section view of the upper portion of a hydraulic tool having an explosive member for actuation.

While the atmospheric chamber 710 formed in downhole tool 700 relies upon a puncture pin in the embodiment disclosed herein, it will be understood that the rupture disk of the downhole tool could be caused to fail in any number of ways and the invention is not limited to an apparatus specifically relying upon a puncture pin. For example, FIG. 5 is a section view of the upper portion of a hydraulic tool 950 with an explosive member used for actuation. Specifically, an explosive charge 960 is disposed directly above rupture disk 965. In order to cause the rupture disk 965 to fail and fluid in atmospheric chamber 970 to be exposed to borehole pressure through ports 975, the explosive charge 960 is detonated using an electrical signal which travels in an electrical wire 980.

While foregoing is directed to the preferred embodiment of the present invention, other and further embodiments of the invention may be devised without departing from the basic scope thereof, and the scope thereof is determined by the claims that follow.

What is claimed is:

1. An apparatus for actuating a downhole tool comprising:

a conduit for flowing fluid therethrough;

a restriction disposed within the conduit, the restriction movable from a first position to a second position;

a pressure line in selective fluid communication with a portion of the conduit above the restriction; and an actuation assembly in fluid communication with the pressure line for actuating the downhole tool.

2. The apparatus of claim 1, wherein the pressure line is in fluid communication with the conduit when the restriction is at the second position.

3. The apparatus of claim 1, wherein actuating the downhole tool occurs while fluid continues to flow through the conduit.

4. The apparatus of claim 1, wherein actuating the downhole tool occurs when the restriction is at the second position.

5. The apparatus of claim 1, wherein the restriction is maintained in the first position using a shearable connection.

6. The apparatus of claim 5, wherein the restriction is moved to the second position when a pressure in the conduit is increased to a predetermined pressure.

7. The apparatus of claim 6, wherein the pressure line is in fluid communication with the conduit when the restriction is at the second position.

8. The apparatus of claim 1, wherein the restriction causes a greater pressure in the conduit thereabove than therebelow.

9. The apparatus of claim 8, wherein the restriction is moved to the second position when a pressure in the conduit is increased to a predetermined pressure.

10. The apparatus of claim 9, wherein the pressure line is in fluid communication with the conduit when the restriction is at the second position.

11. The apparatus of claim 10, wherein actuating the downhole tool occurs when the restriction is at the second position.

12. The apparatus of claim 11, wherein actuating the downhole tool occurs while fluid continues to flow through the conduit.

13. An apparatus for use in a wellbore, comprising:

a tubular member having conduit for flowing fluid therethrough;

a restriction disposed in a first position within the conduit, the restriction movable from a first position to a second position when a pressure in the conduit is increased to a predetermined level;

a pressure line attached to the tubular member, wherein the pressure line is in fluid communication with a portion of the conduit above the restriction when the restriction is at the second position; and an actuating member in fluid communication with the pressure line for actuating the downhole tool.

14. The apparatus of claim 13, wherein the actuating member comprises a piston having a piston surface in fluid communication with the pressure line.

15. The apparatus of claim 14, wherein the piston is selectively movable from a first position to a second position.

16. The apparatus of claim 15, wherein the piston is moved to the second position when the pressure line is in fluid communication with the conduit.

17. The apparatus of claim 16, wherein the downhole tool is hydraulically actuatable.

18. The apparatus of claim 17, further comprising a whipstock and a cutter.

19. The apparatus of claim 18, further comprising a tool for determining orientation of the apparatus in the wellbore.

20. The apparatus of claim 19, wherein the tool for determining orientation is a MWD tool.

21. The apparatus of claim 15, wherein in the piston further comprises a projection for penetrating a chamber disposed in the downhole tool.

22. The apparatus of claim 21, wherein a pressure in the chamber is less then a pressure in the wellbore.

23. The apparatus of claim 22, wherein the projection penetrates the chamber when the piston is moved to the second position, thereby causing the chamber pressure to increase to the wellbore pressure.

24. The apparatus of claim 23, wherein the downhole tool is hydraulically actuatable.

25. A method for selectively actuating a downhole tool, comprising:

flowing a fluid through a conduit;

restricting the fluid flow through a portion of the conduit;

increasing the fluid flow in the conduit to cause a pressure line to be in fluid communication with the conduit;

communicating the fluid flow through the pressure line to an actuation member; and actuating the downhole tool.

26. The method of claim 25, wherein restricting the fluid flow comprises flowing the fluid through a piston member disposed in the conduit.

27. The method of claim 26, wherein the piston member is selectively movable between a first position and a second position.

28. The method of claim 26, wherein the piston member is maintained in the first position using a shearable connection.

29. The method of claim 28, wherein increasing the fluid flow moves the piston member from the first position to the second position.

30. The method of claim 26, wherein the piston member comprises a restriction member, whereby the restriction member causes a pressure differential across the restriction member.

31. The method of claim 25, further comprising maintaining the fluid flow through the restriction member while actuating the downhole tool.

32. The method of claim 25, wherein the actuation member is hydraulically actuatable.

33. The method of claim 32, wherein the actuation member comprise an actuation piston selectively movable between a first position and a second position.

34. The method of claim 33, wherein the actuation piston is maintained in the first position using a shearable connection.

35. The method of claim 34, wherein communicating the fluid flow to the actuation member breaks the shearable connection.

36. The method of claim 33, wherein communicating the fluid flow to the actuation member moves the actuation piston from the first position to the second position.

37. An apparatus for actuating a downhole tool comprising:

a first conduit for flowing fluid therethrough;

a pressure sensing line in communication with the first conduit; and the pressure sensing line sensing pressure in the first conduit and communicating a predetermined pressure to actuate the downhole tool while fluid flow is maintained through the first conduit.

38. The apparatus of claim 37, where the first conduit includes a pressure changing restriction therein, the restriction creating a greater pressure in the conduit thereabove than therebelow.

39. The apparatus of claim 38, wherein the restriction is movable from a first to a second position within the first conduit.

40. The apparatus of claim 38, wherein the pressure sensing line and the restriction are movable relative to one another.

41. The apparatus of claim 39, whereby movement of the restriction from the first to the second position exposes the pressure sensing line to the greater pressure.

42. The apparatus of claim 41, whereby when the greater pressure reaches the predetermined pressure, the downhole tool is actuated.

* * * * *